US009079437B1

(12) United States Patent
Takabatake et al.

(10) Patent No.: US 9,079,437 B1
(45) Date of Patent: Jul. 14, 2015

(54) PRINTER

(71) Applicant: FUJITSU COMPONENT LIMITED, Tokyo (JP)

(72) Inventors: Yoshinari Takabatake, Tokyo (JP); Sumio Watanabe, Tokyo (JP); Yukihiro Mori, Tokyo (JP); Masafumi Chiba, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 14/627,143

(22) Filed: Feb. 20, 2015

(30) Foreign Application Priority Data

Feb. 28, 2014 (JP) ..... 2014-039620

(51) Int. Cl.
*B41J 2/01* (2006.01)
*B41J 2/325* (2006.01)
*B41J 11/70* (2006.01)

(52) U.S. Cl.
CPC ..... *B41J 11/70* (2013.01)

(58) Field of Classification Search
USPC ..... 347/171–178, 212–215, 218, 222, 104, 347/16; 400/120.01–120.04, 237, 611, 621, 400/621.1, 124.11; 83/166, 614, 922
See application file for complete search history.

(56) References Cited

U.S. PATENT DOCUMENTS

| | | | | |
|---|---|---|---|---|
| 5,159,350 | A * | 10/1992 | Minaminaka | 347/211 |
| 8,411,119 | B2 | 4/2013 | Tsuchiya et al. | |
| 8,562,229 | B2 * | 10/2013 | Inaba et al. | 400/621 |
| 8,888,388 | B2 * | 11/2014 | Mochida et al. | 400/621 |
| 8,911,166 | B2 * | 12/2014 | Tsukada | 400/621 |
| 2006/0082637 | A1 * | 4/2006 | Sanbongi et al. | 347/213 |
| 2010/0232092 | A1 | 9/2010 | Sakamoto | |

FOREIGN PATENT DOCUMENTS

| | | |
|---|---|---|
| JP | 2010-173129 | 8/2010 |
| JP | 2010-214658 | 9/2010 |

* cited by examiner

*Primary Examiner* — Kristal Feggins
(74) *Attorney, Agent, or Firm* — IPUSA, PLLC

(57) ABSTRACT

A printer includes a printer body, a lid, a cutter, a fixed blade unit provided in the printer body and including the fixed blade of the cutter, a movable blade unit provided on the lid and including the movable blade of the cutter, and a gimbal plate attached to the lid. The movable blade unit is connected to the gimbal plate. A paper discharge opening is formed between the printer body and an end of the lid. The lid includes a first recording paper guide that projects toward the movable blade and is positioned at the end of the lid. The gimbal plate includes a second recording paper guide that projects toward the movable blade and is positioned at an end of the gimbal plate facing the paper discharge opening.

5 Claims, 14 Drawing Sheets

PRINTER

CROSS-REFERENCE TO RELATED APPLICATION

The present application is based upon and claims the benefit of priority of Japanese Patent Application No. 2014-039620, filed on Feb. 28, 2014, the entire contents of which are incorporated herein by reference.

BACKGROUND OF THE INVENTION

1. Field of the Invention

The present invention relates to printers.

2. Description of the Related Art

Printers that output receipts are widely used for shop registers and automated teller machines (ATMs) or cash dispensers (CDs) in banks. In such printers that output receipts, printing is performed on thermal paper that serves as recording paper or sheets with a thermal head while conveying the recording paper, and after conveying the recording paper a predetermined length, the recording paper is cut by a cutter to the predetermined length. Such a cutter includes a fixed blade and a movable blade, and the movable blade moves toward the fixed blade so as to cut the recording paper held between the fixed blade and the movable blade.

Such printers include clamshell printers. Clamshell printers include a printer body and a lid that is connected to the printer body in such a manner as to be openable and closable relative to the printer body. By closing the lid after loading a roll of recording paper into the printer body, printing is ready to be performed on the recording paper. Clamshell printers as well include a cutter for cutting the recording paper. Because the recording paper is held and cut between the fixed blade and the movable blade of the cutter, one of the fixed blade and the movable blade is provided in the printer body and the other is provided on the lid. Therefore, according to clamshell printers, by closing the lid, the fixed blade and the movable blade are placed at predetermined positions where the fixed blade and the movable blade function as a cutter, so that the recording paper is ready to be cut with the fixed blade and the movable blade.

Reference may be made to Japanese Laid-Open Patent Applications No. 2010-173129 and No. 2010-214658.

SUMMARY OF THE INVENTION

According to an aspect of the present invention, a printer includes a printer body, a lid, a cutter, a fixed blade unit provided in the printer body and including the fixed blade of the cutter, a movable blade unit provided on the lid and including the movable blade of the cutter, and a gimbal plate attached to the lid. The movable blade unit is connected to the gimbal plate. A paper discharge opening is formed between the printer body and an end of the lid. The lid includes a first recording paper guide that projects toward the movable blade and is positioned at the end of the lid. The gimbal plate includes a second recording paper guide that projects toward the movable blade and is positioned at an end of the gimbal plate facing the paper discharge opening.

DESCRIPTION OF THE EMBODIMENTS

Figure 1:
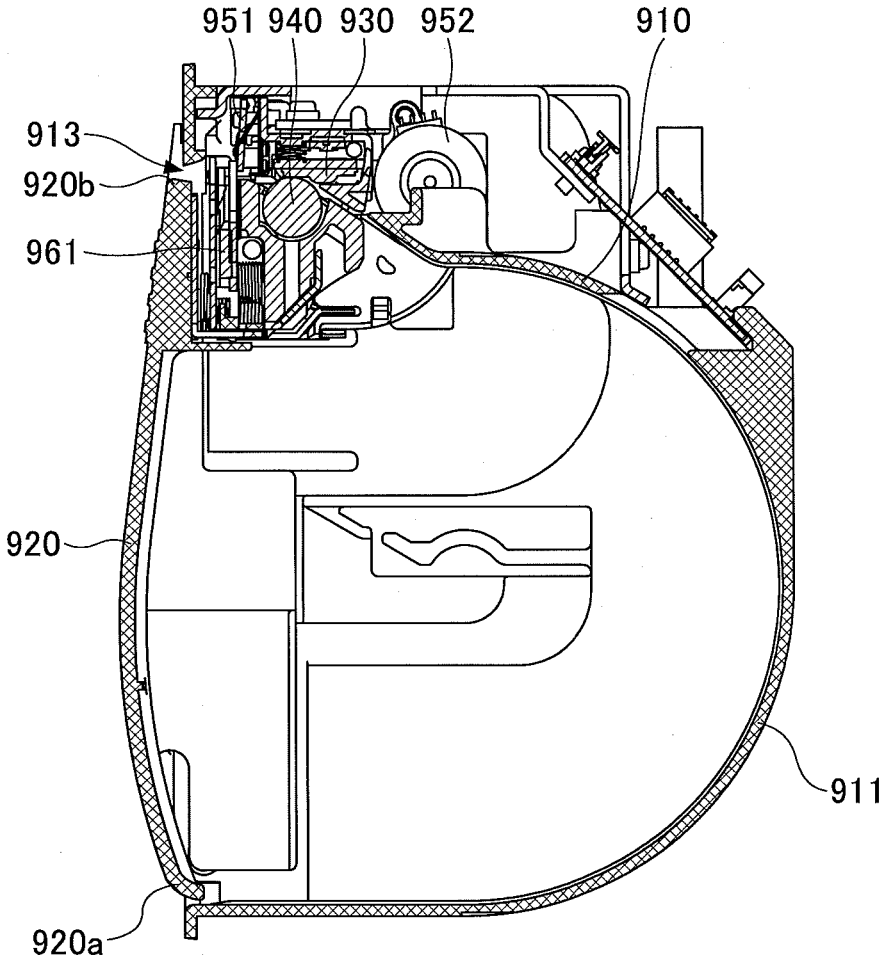
FIG. 1 is a cross-sectional view of a printer with a lid closed.

One or more embodiments of the present invention are described below with reference to the accompanying drawings. The same elements are referred to by the same reference numeral, and are not further described.

Figure 2:
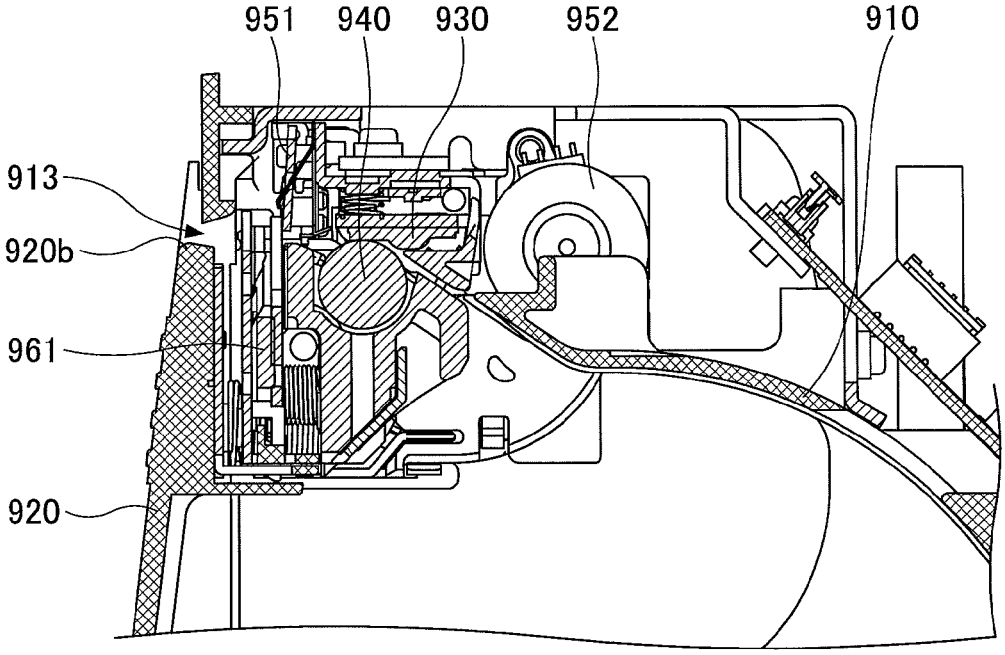
FIG. 2 is an enlarged cross-sectional view of part of the printer of FIG. 1.

First, a description is given of a clamshell printer. As illustrated in FIGS. 1 and 2, the clamshell printer includes a printer body 910 and a lid 920. FIG. 1 is a cross-sectional view of the clamshell printer. FIG. 2 is an enlarged view of part of FIG. 1.

The printer body 910 includes a recording paper holder 911 that defines a space for loading a roll of recording paper. A first end 920*a* of the lid 920 is connected to the printer body 910 in such a manner as to allow the lid 920 to be opened and closed relative to the printer body 910. That is, a rotation shaft provided on part of the lid 920 near the first end 920*a* is connected to the printer body 910, and the lid 920 is opened and closed relative to the printer body 910 by rotating the lid 920 about the rotation shaft. At the time of using the printer, a roll of recording paper is placed inside the recording paper holder 911 of the printer body 910, and the lid 920 is closed. As a result, printing is ready to be performed on the recording paper in the printer.

The printer includes a thermal head 930 provided in the printer body 910. The thermal head 930 operates as a print head. The printer includes a platen roller 940 provided on the lid 920. The printer also includes a fixed blade 951 provided in the printer body 910 and a movable blade 961 provided on the lid 920. The printer further includes a conveyance motor 952 for rotating the platen roller 940 to convey the recording paper. The platen roller 940 and the movable blade 961 are provided near a second end 920*b* of the lid 920.

The recording paper subjected to printing by the thermal head 930 passes between the fixed blade 951 and the movable blade 961, which form a cutter, and is discharged through a paper discharge opening 913. The paper discharge opening 913 is formed by a gap between the second end 920*b* of the lid 920 and the printer body 910. In the case of the printer illustrated in FIGS. 1 and 2, if there is a gap between the lid 920 and the movable blade 961 in the paper discharge opening 913, the recording paper discharged through the paper discharge opening 913 enters the gap to cause a paper jam. The paper jam occurs notably especially when the recording paper wound in a roll has a strong curl.

Therefore, this problem may be solved if it is possible to provide the movable blade 961 directly on the interior side of the lid 920. The movable blade 961, however, has a mechanical portion and a housing portion in order to perform sliding, thus resulting in a gap between the lid 920 and the movable blade 961. Furthermore, in the case where a gimbal plate or the like is connected to a movable blade unit that includes a movable blade as described below, the gap between the lid 920 and the movable blade 961 further widens, so that the recording paper is more likely to enter the gap to cause a paper jam.

A printer according to an embodiment is described with reference to FIGS. 3 through 8.

Figure 3:
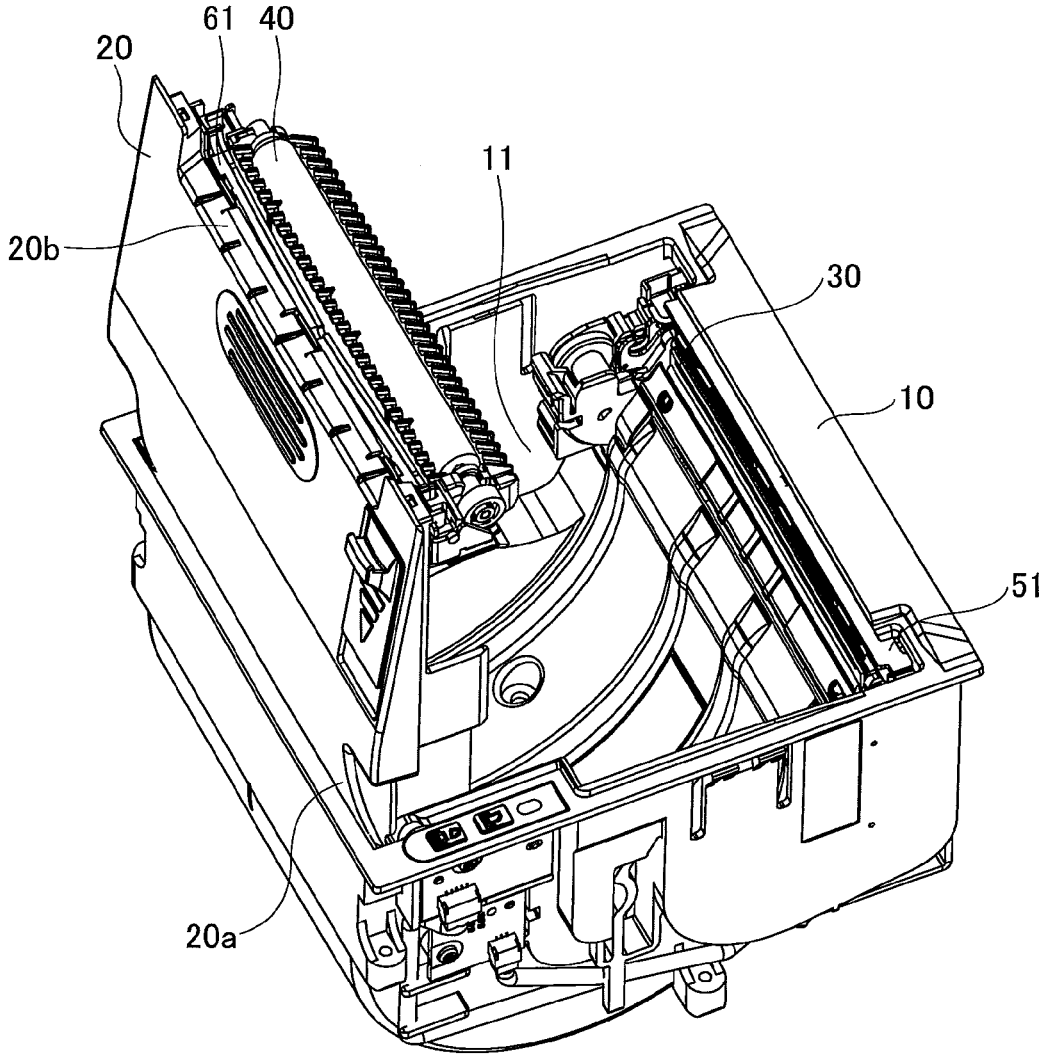
FIG. 3 is a perspective view of a printer with a lid opened according to an embodiment.
Figure 4:
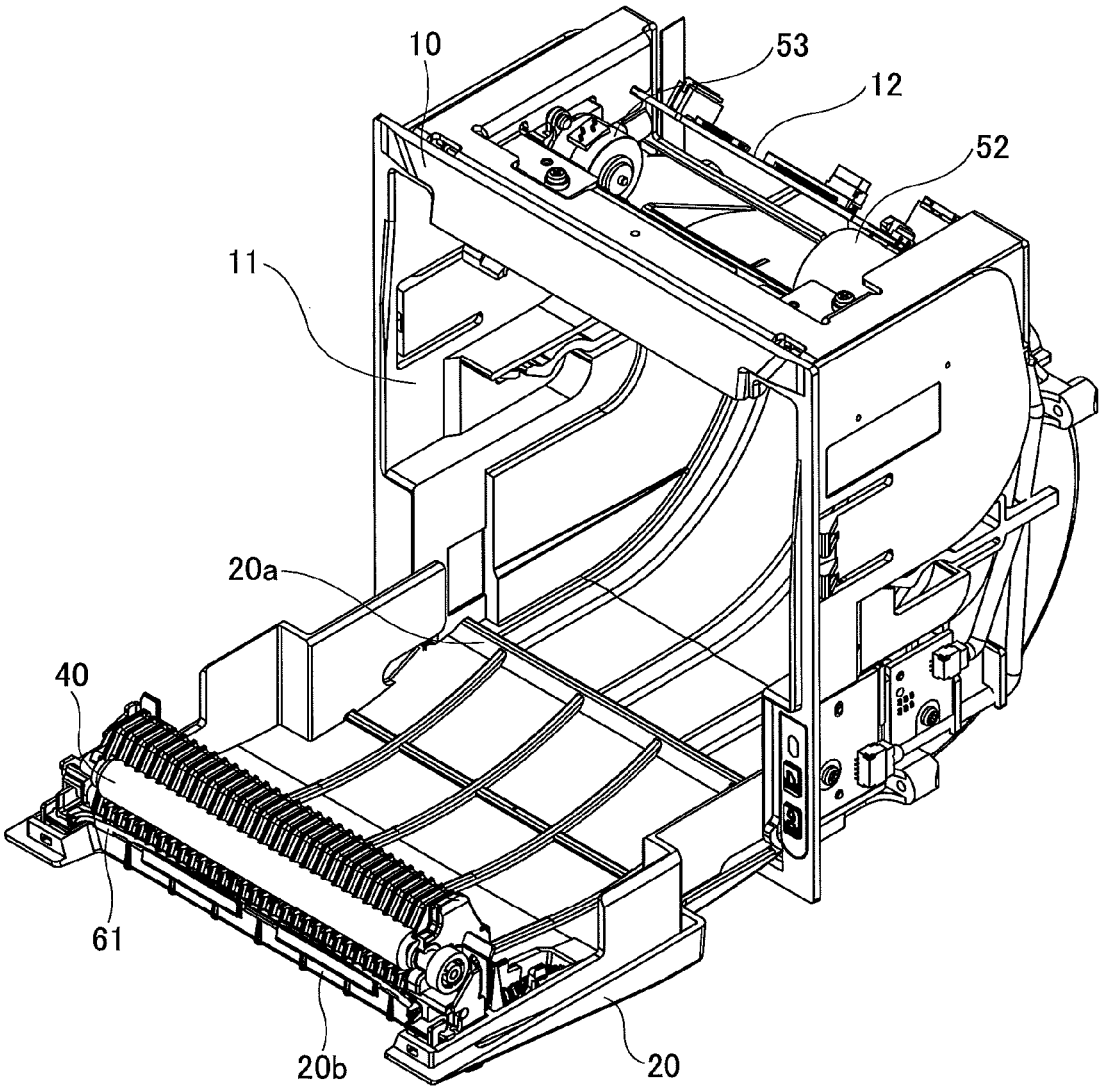
FIG. 4 is a perspective view of the printer with the lid opened according to the embodiment.
Figure 5:
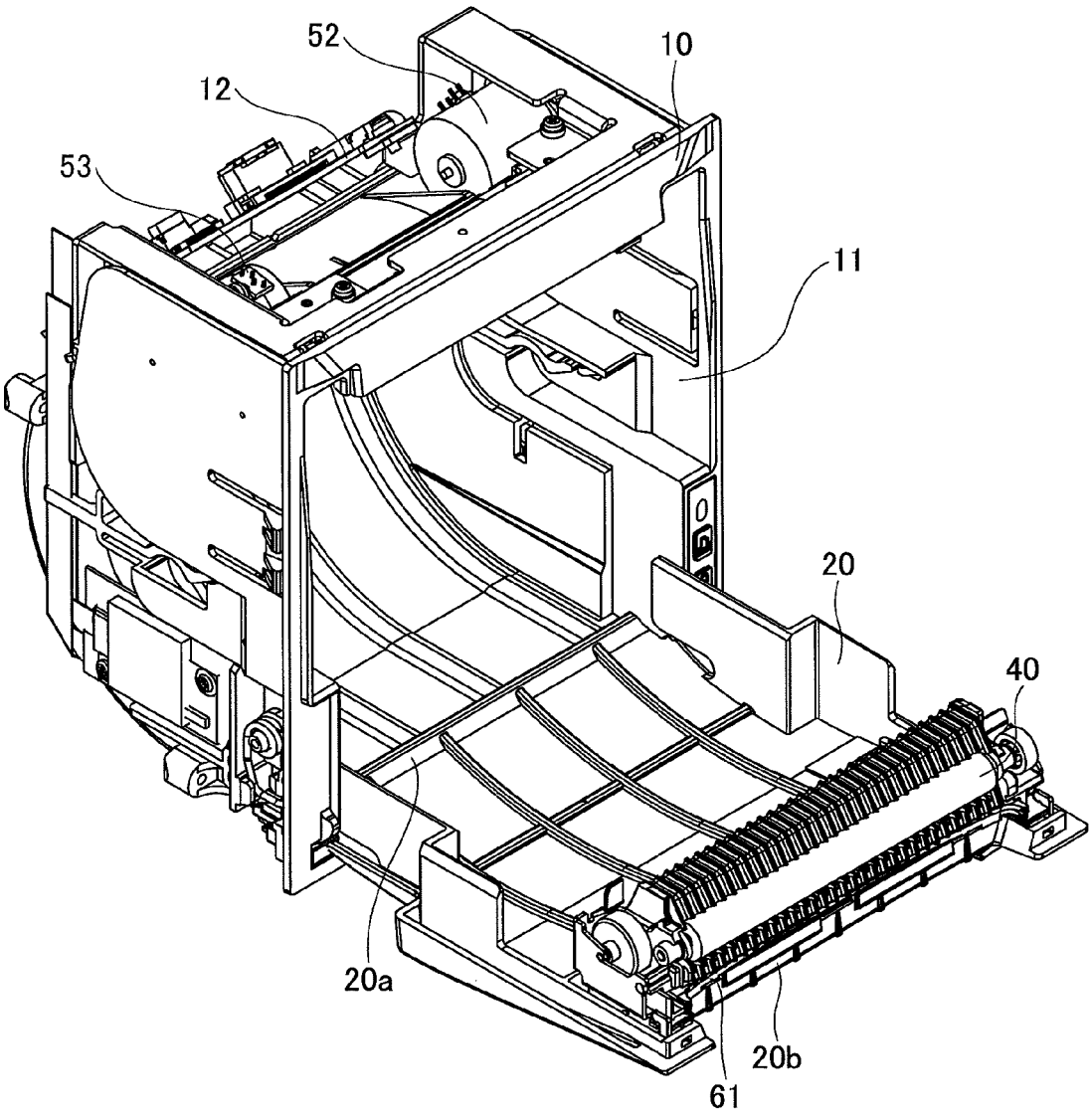
FIG. 5 is a perspective view of the printer with the lid opened according to the embodiment.
Figure 6:
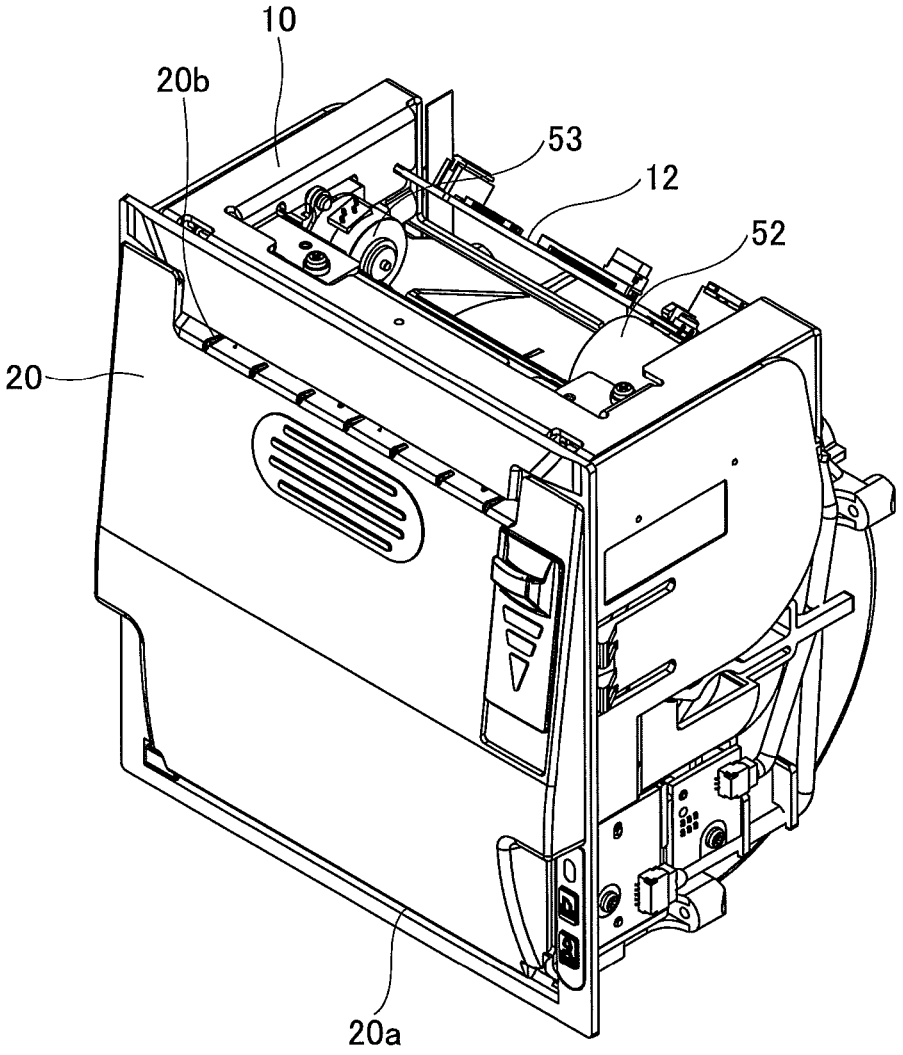
FIG. 6 is a perspective view of the printer with the lid closed according to the embodiment.
Figure 7:
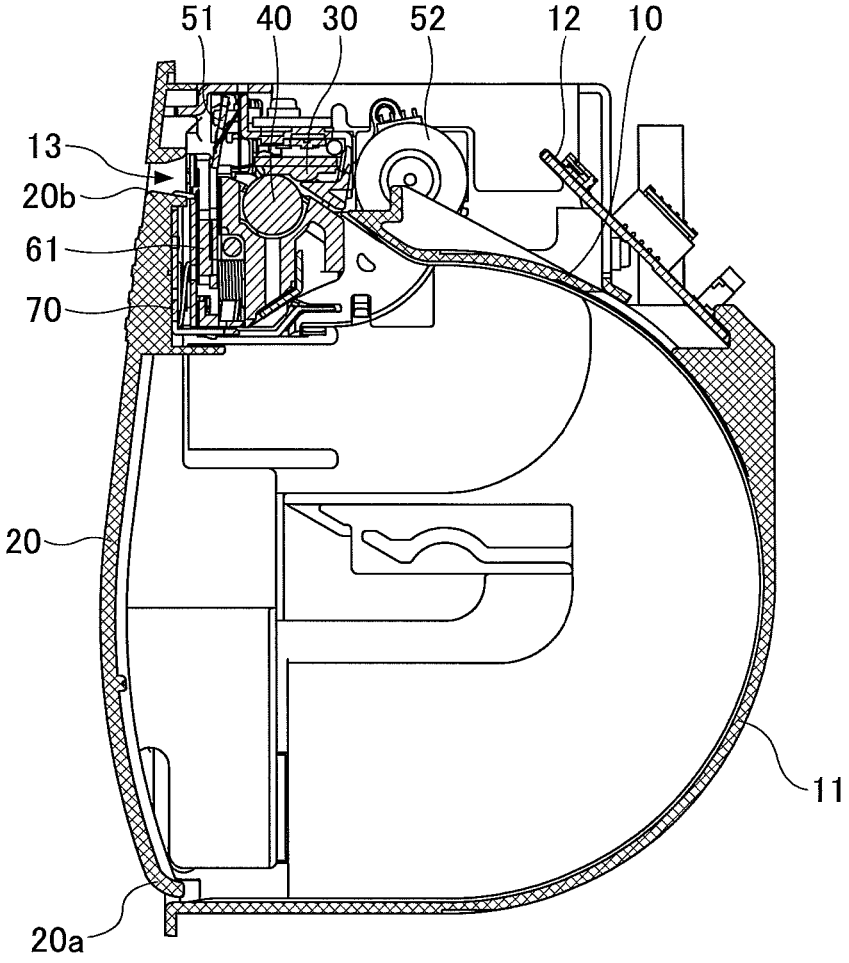
FIG. 7 is a cross-sectional view of the printer with the lid closed according to the embodiment.
Figure 8:
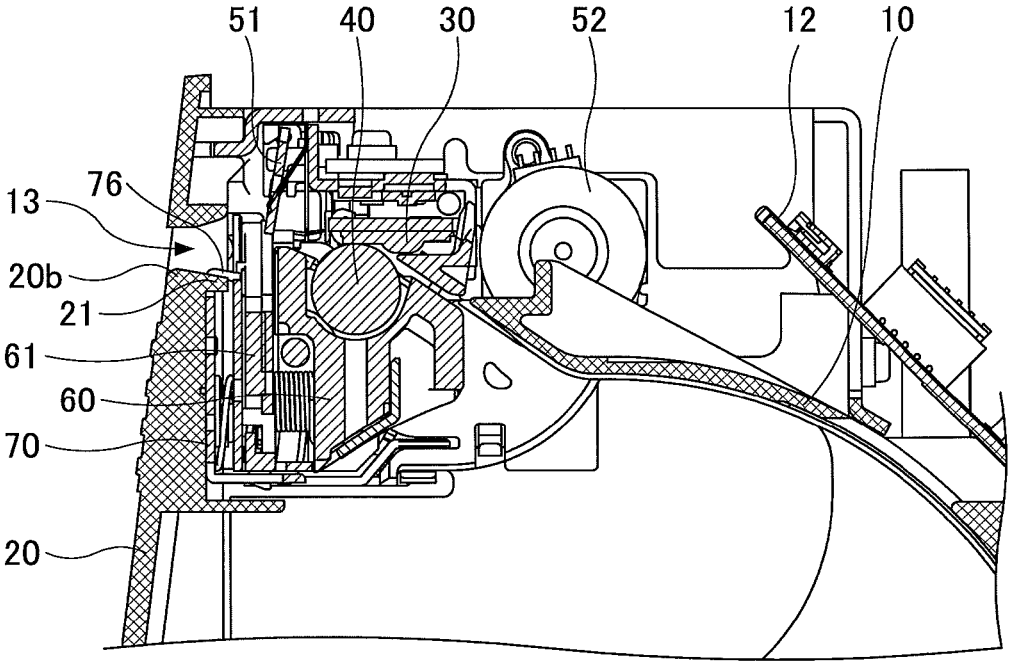
FIG. 8 is an enlarged cross-sectional view of part of the printer with the lid closed according to the embodiment.

FIGS. 3 through 5 are perspective views of the printer with the lid opened, taken from different directions. FIG. 6 is a perspective view of the printer with the lid closed. FIG. 7 is a cross-sectional view of the printer with the lid closed. FIG. 8 is an enlarged cross-sectional view of part of FIG. 7.

According to this embodiment, the printer is of a clamshell type, and includes a printer body 10 and a lid 20. The printer body 10 includes a recording paper holder 11 that defines a space for loading a roll of recording paper. A first end 20*a* of the lid 20 is connected to the printer body 10 in such a manner as to allow the lid 20 to be opened and closed relative to the printer body 10. That is, a rotation shaft 20*c* (illustrated in FIG. 14) provided on part of the lid 20 near the first end 20*a* is connected to the printer body 10, and the lid 20 is opened and closed relative to the printer body 10 by rotating the lid 20 about the rotation shaft 20*c*.

According to this embodiment, at the time of using the printer, a roll of recording paper is placed inside the recording paper holder 11 of the printer body 10, and the lid 20 is closed as illustrated in FIG. 6. As a result, printing is ready to be performed on the recording paper in the printer.

The printer includes a thermal head 30 provided in the printer body 10. The thermal head 30 operates as a print head. The printer includes a platen roller 40 provided on the lid 20. The printer also includes a fixed blade 51 provided in the printer body 10 and a movable blade 61 provided on the lid 20. The printer further includes a conveyance motor 52 for rotating the platen roller 40 to convey the recording paper, and a movable blade motor 53 for driving the movable blade 61. The conveyance motor 52 and the movable blade motor 53 are provided in the printer body 10. The platen roller 40 and the movable blade 61 are provided near a second end 20*b* of the lid 20.

According to the printer, by closing the lid 20, the recording paper is held between the thermal head 30 and the platen roller 40, and is held between the fixed blade 51 and the movable blade 61. Thus, by closing the lid 20, the fixed blade 51 and the movable blade 61 are placed at predetermined positions to form a cutter, so that printing and cutting are ready to be performed on the recording paper. The printer further includes a control board 12 provided outside the printer body 10. The control board 12 is for controlling the printer.

According to the printer, the recording paper subjected to printing by the thermal head 30 passes between the fixed blade 51 and the movable blade 61, which form a cutter, and is discharged through a paper discharge opening 13. The paper discharge opening 13 is formed by a gap between the second end 20*b* of the lid 20 and the printer body 10.

Figure 9A:
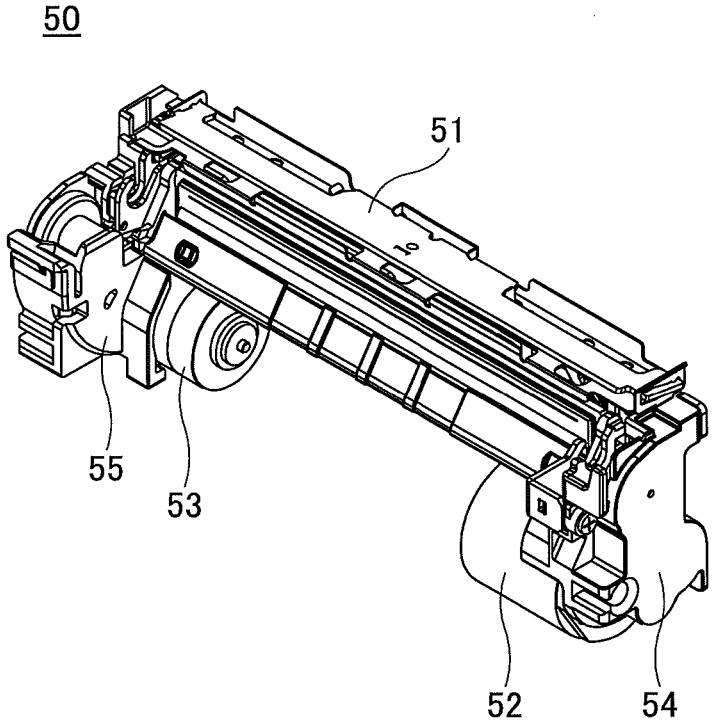
FIGS. 9A and 9B are diagrams illustrating a fixed blade unit of the printer according to the embodiment.
Figure 9B:
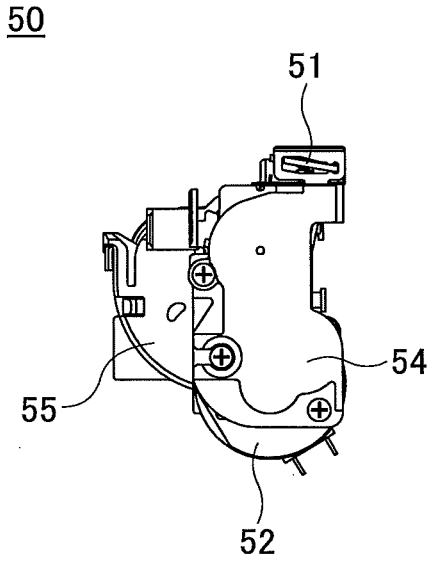

The printer includes a fixed blade unit 50 provided in the printer body 10. The fixed blade unit 50 includes the fixed blade 51. FIG. 9A is a perspective view of the fixed blade unit 50. FIG. 9B is a side view of the fixed blade unit 50. The fixed blade unit 50 includes the fixed blade 51, the conveyance motor 52, the movable blade motor 53, a conveyance gear box 54, and a movable blade gear box 55. The conveyance gear box 54 covers multiple conveyance gears provided inside the conveyance gear box 54. The movable blade gear box 55 covers multiple movable blade gears provided inside the movable blade gear box 55.

The platen roller 40 is rotated via the conveyance gears inside the conveyance gear box 54 by rotating the conveyance motor 52. The movable blade 61 is slid via the movable blade gears inside the movable blade gear box 55 by rotating the movable blade motor 53.

The conveyance gear box 54 and the movable blade gear box 55 are die castings made of zinc. The conveyance gear box 54 and the movable blade gear box 55 are positioned at a first longitudinal end and a second longitudinal end of the fixed blade unit 50, respectively.

Figure 10A:
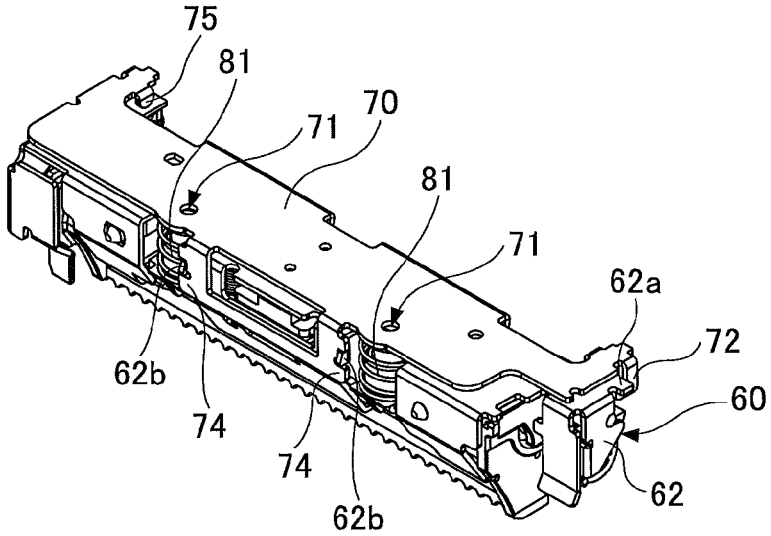
FIGS. 10A and 10B are diagrams illustrating a movable blade unit of the printer according to the embodiment.
Figure 10B:
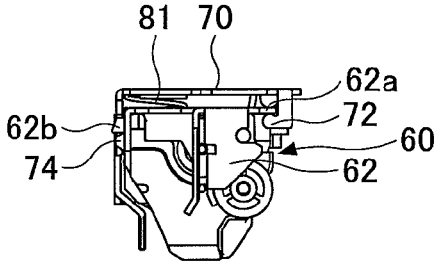
Figure 11:
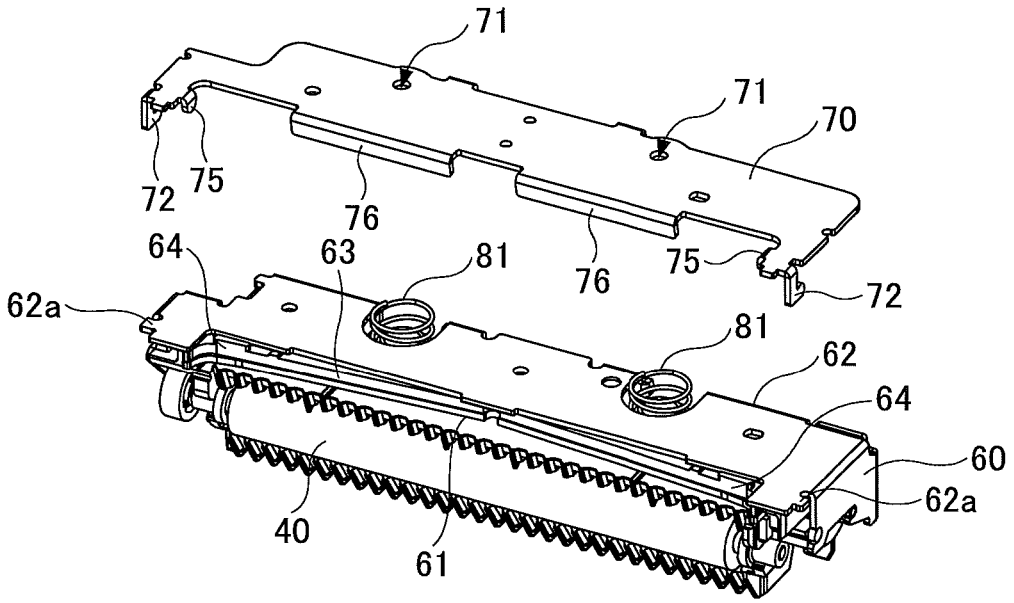
FIG. 11 is a diagram illustrating the movable blade unit of the printer according to the embodiment.

Furthermore, the printer includes a movable blade unit 60 as illustrated in FIGS. 10A, 10B and 11 provided near the second end 20*b* of the lid 20. The movable blade unit 60 includes the movable blade 61. FIG. 10A is a perspective view of the movable blade unit 60. FIG. 10B is a side view of the movable blade unit 60. FIG. 11 is a perspective view of the movable blade unit 60 with the platen roller 40 attached to and a gimbal plate 70 removed from the movable blade unit 60.

The movable blade unit 60 includes a movable blade unit housing 62. The movable blade unit housing 62 in its entirety is formed by bending a metal plate of stainless steel or the like. The movable blade 61 is provided inside the movable blade unit housing 62. The gimbal plate 70 is connected to the movable blade unit 60 on the side on which the movable blade unit 60 is attached to the lid 20. Two coil springs 81 are provided so as to intervene between the gimbal plate 70 and the movable blade unit 60. According to this embodiment, a screw is inserted through each of two attachment holes 71 formed in the gimbal plate 70, and the gimbal plate 70 is screwed to the lid 20 with the screws, so that the movable blade unit 60 is attached to the lid 20. Each attachment hole 71 is provided so as to align with the axial center of the corresponding coil spring 81.

The movable blade unit 60 is described in more detail with reference to FIG. 11. The gimbal plate 70 is formed by processing a metal plate of stainless steel or the like. The movable blade unit 60 includes a rack 63, and the movable blade 61 is attached to the rack 63. The movable blade 61 is slid together with the rack 63 via the movable blade gears in the movable blade gear box 55 by rotating the movable blade motor 53 in the fixed blade unit 50.

According to the printer, as illustrated in FIG. 11, the rack 63 includes third recording paper face guides 64, one provided near each longitudinal end of the rack 63 so as to project toward the gimbal plate 70. The third recording paper face guides 64 are positioned so as not to overlap below-described second recording paper face guides 76 when the rack 63 slides. By thus forming the third recording paper face guides 64 near the longitudinal ends of the rack 63, it is possible to further ensure prevention of the occurrence of a paper jam.

Figure 12A:
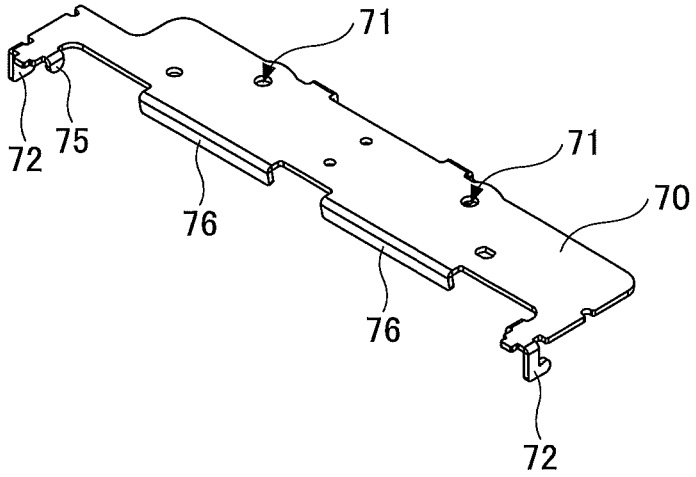
FIGS. 12A and 12B are diagrams illustrating a gimbal plate.
Figure 12B:
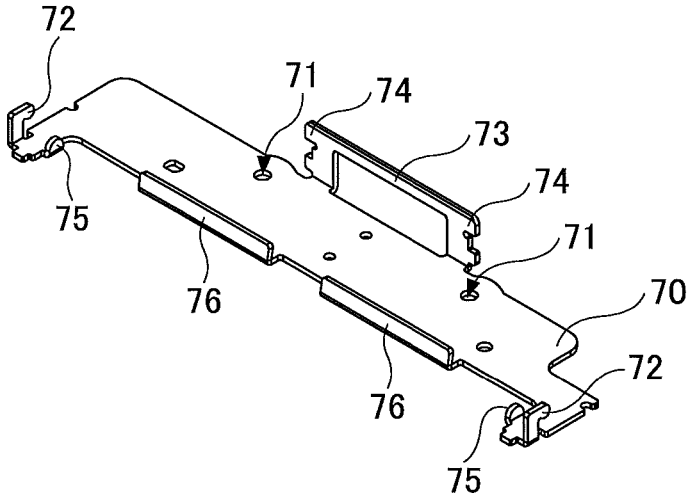

Next, the gimbal plate 70 is described in more detail with reference to FIGS. 12A and 12B. FIG. 12A is a top-side perspective view of the gimbal plate 70. FIG. 12B is a bottom-side perspective view of the gimbal plate 70. The gimbal plate 70 includes L-shaped first hooks 72 one at each longitudinal end of the gimbal plate 70. The gimbal plate 70 includes a connection bent part 73 projecting downward from a central portion of a first side edge of the gimbal plate 70 extending in a longitudinal direction of the gimbal plate 70. The connection bent part 73 is elongated in a longitudinal direction of the gimbal plate 70, and includes second hooks 74 one at each longitudinal end of the connection bent part 73. Thus, the gimbal plate 70 includes the first hooks 72 provided at two points and also the second hooks 74 provided at two points.

The first hooks 72 and the second hooks 74 are provided on opposite sides of the gimbal plate 70, so that the first hooks 72 are closer to and the second hooks 74 are farther from the fixed blade 51 when the gimbal plate 70 is connected to the movable blade unit 60 and provided on the lid 20. The gimbal plate 70 is formed by bending a metal plate, so that an L-shaped surface of each first hook 72 is in a plane perpendicular to a longitudinal direction of the connection bent part 73.

At the time of connecting the gimbal plate 70 to the movable blade unit 60, first, the first hooks 72 of the gimbal plate 70 are caught on first projections 62*a* one formed at each longitudinal end of the movable blade unit housing 62 as illustrated in FIGS. 10A and 11. Thereafter, the second hooks 74 are caught on second projections 62*b* of the movable blade unit housing 62. As a result, the gimbal plate 70 is connected to the movable blade unit 60. At this point, the coil springs 81 intervening between the gimbal plate 70 and the movable blade unit 60 urge the gimbal plate 70 in a direction away from the movable blade unit 60. The gimbal plate 70 is connected to the movable blade unit 60 by engaging the first hooks 72 with the first projections 62*a* and engaging the second hooks 74 with the second projections 62*b* against the resilience of the coil springs 81.

The coil springs 81 are provided so that the positions of the attachment holes 71 used for attaching the gimbal plate 70 to the lid 20 align with the internal spaces of the coil springs 81. By thus providing the coil springs 81 so that the internal spaces of the coil springs 81 align with the positions of the attachment holes 71, it is possible to ensure a workspace for fixing the gimbal plate 70 to the lid 20 with screws. In other words, the misalignment of the internal spaces of the coil springs 81 and the positions of the attachment holes 71 would increase the size of the printer. According to this embodiment, however, the internal spaces of the coil springs 81 and the positions of the attachment holes 71 are aligned. Accordingly, it is possible to make effective use of dead spaces in the internal spaces of the coil springs 81 as a workspace for attaching the gimbal plate 70 to the lid 20 with screws, so that the printer is reduced in size.

Furthermore, recording paper side guides 75 and the second recording paper face guides 76 that come into contact with and guide recording paper are provided on the side of the gimbal plate 70 closer to the fixed blade 51. The recording paper side guides 75 guide the side edges of the recording paper, and are provided one near each longitudinal end of the gimbal plate 70. That is, the recording paper side guides 75 are provided at two points. The second recording paper face guides 76 guide the paper face of the recording paper. The second recording paper face guides 76 are provided at two points on a second side edge of the gimbal plate 70 opposite to the first side edge so as to project downward to come into contact with the recording paper.

Figure 13A:
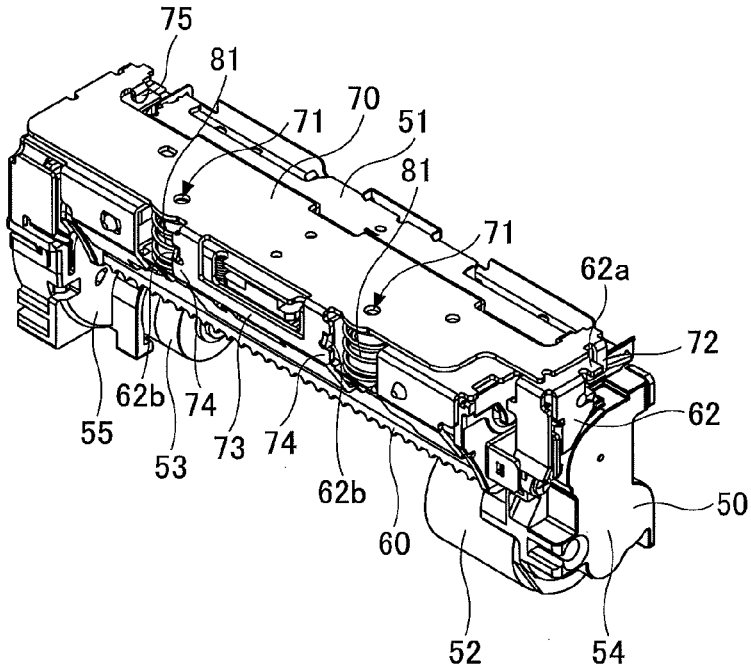
FIGS. 13A and 13B are diagrams illustrating the fixed blade unit and the movable blade unit of the printer in a connected state according to the embodiment.
Figure 13B:
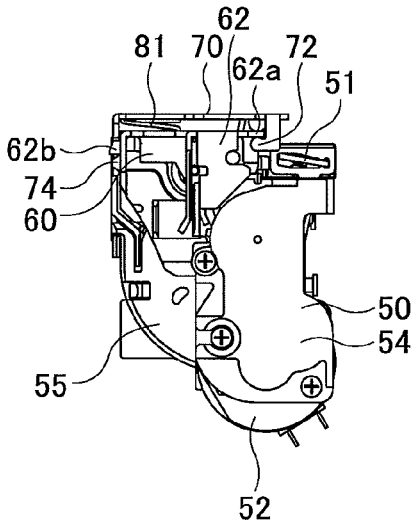

The fixed blade 51 and the movable blade 61 form a cutter. By closing the lid 20, the fixed blade unit 50 illustrated in FIGS. 9A and 9B and the movable blade unit 60 illustrated in FIGS. 10A and 10B are connected as illustrated in FIGS. 13A and 13B. FIGS. 13A and 13B are a perspective view and a side view, respectively, of the fixed blade unit 50 and the movable blade unit 60 with the lid 20 closed in the printer.

Figure 14:
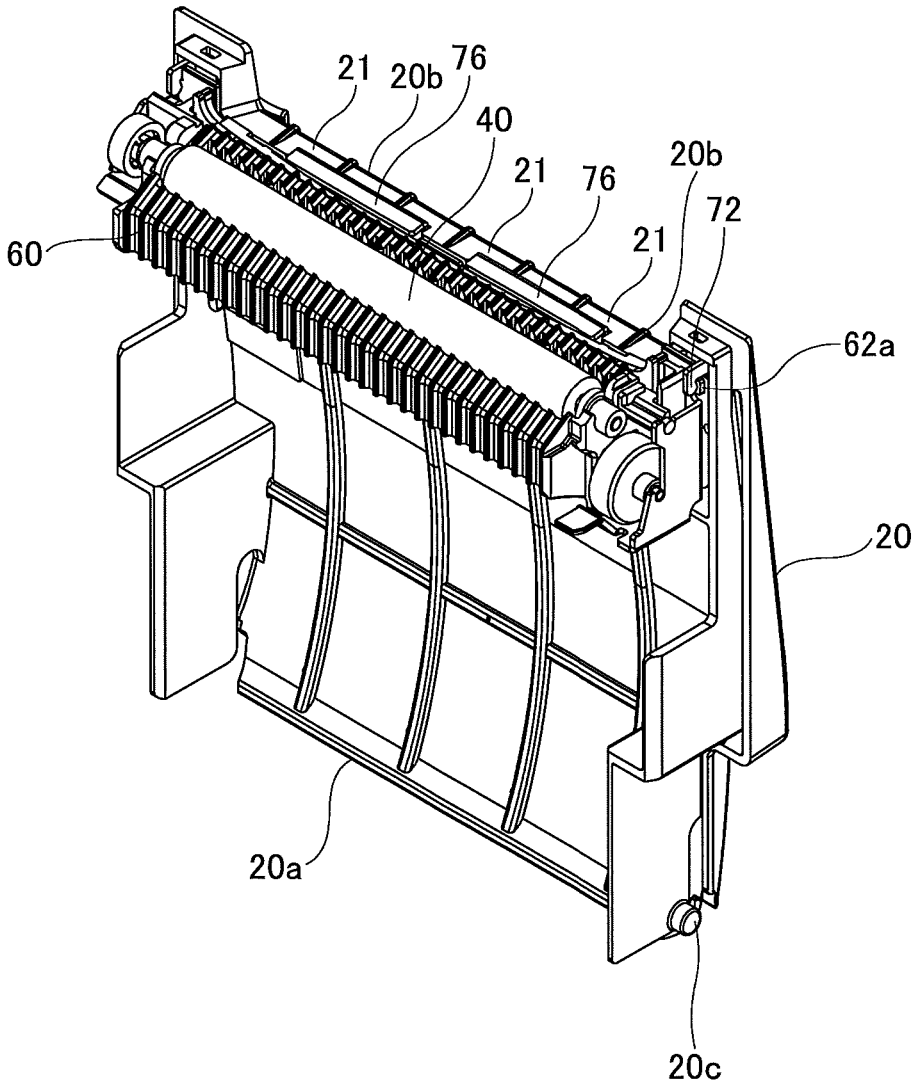
FIG. 14 is a perspective view of the lid on which the movable blade unit is provided.

Next, first recording paper face guides 21 and the second recording paper face guides 76 of the printer are described with reference to FIGS. 8 and 14. FIG. 14 is a perspective view of the lid 20 removed from the printer body 10. As illustrated in FIG. 14, the rotation shaft 20*c* is provided on part of the lid 20 near the first end 20*a*, and the lid is rotatably connected to the printer body 10 via the rotation shaft 20*c*.

According to the printer, the second end 20*b* of the lid 20 that forms the paper discharge opening 13 is bent toward the movable blade 61, and the bent portions of the second end 20*b* form the first recording paper face guides 21 that guide recording paper. Likewise, the gimbal plate 70 attached to the lid 20 is bent on the paper discharge opening 13 side, and the bent portions of the gimbal plate 70 form the second recording paper face guides 76. The second recording paper face guides 76 are formed at predetermined intervals. The first recording paper face guides 21 are formed so as to enter spaces where the second recording paper face guides 76 are not formed.

By thus forming the first recording paper face guides 21 at the second end 20*b* of the lid 20 and forming the second recording paper face guides 76 on the gimbal plate 70, it is possible to make the gap between the movable blade 61 and the lid 20 extremely narrow in the paper discharge opening 13. That is, according to the printer, because the first recording paper face guides 21 and the second recording paper face guides 76 are formed between the movable blade 61 and the lid 20 in the paper discharge opening 13, there is no substantial space between the movable blade 61 and the lid 20. Accordingly, it is possible to prevent recording paper from entering a space between the movable blade 61 and the lid 20, so that it is possible to prevent the occurrence of a paper jam. As a result, it is possible to prevent recording paper from causing a paper jam.

According to this embodiment, as described above, the first recording paper face guides 21 are formed at the second end 20*b* of the lid 20 and the second recording paper face guides 76 are formed on the gimbal plate 70 in the paper discharge opening 13 as illustrated in FIGS. 8 and 14. The first recording paper face guides 21 are formed at three points at the second end 20*b* of the lid, for example, at a first end, a second end, and the center of the second end 20*b* in its longitudinal direction. Furthermore, the second recording paper face guides 76 of the gimbal plate 70 are formed so as to enter spaces formed among the first recording paper face guides 21. That is, the second recording paper face guides 76 are formed at two points, so that one of the second recording paper face guides 76 enters a space between the first recording paper face guides 21 positioned at the first end and the center of the second end 20*b* of the lid 20 and the other of the second recording paper face guides 76 enters a space between the first recording paper face guides 21 positioned at the second end and the center of the second end 20*b* of the lid 20.

Therefore, according to the printer of this embodiment, because the gap between the movable blade 61 and the lid 20 is extremely narrow, recording paper is prevented from entering the gap. Therefore, it is possible to prevent recording paper from being jammed between the movable blade 61 and the lid 20 in the paper discharge opening 13.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. A printer, comprising:

a printer body including a print head;

a lid connected to the printer body so as to be opened and closed relative to the printer body;

a cutter including a fixed blade and a movable blade that cuts recording paper;

a fixed blade unit provided in the printer body, the fixed blade unit including the fixed blade;

a movable blade unit provided on the lid, the movable blade unit including the movable blade; and a gimbal plate attached to the lid and to which the movable blade unit is connected, wherein a paper discharge opening through which the recording paper is discharged is formed by a gap between the printer body and an end of the lid, the lid includes a first recording paper guide projecting toward the movable blade, the first recording paper guide being positioned at the end of the lid, and the gimbal plate includes a second recording paper guide projecting toward the movable blade, the second recording paper guide being positioned at an end of the gimbal plate facing the paper discharge opening.

2. The printer as claimed in claim 1, wherein the first recording paper guide is positioned in a space where the second recording paper guide is absent.

3. The printer as claimed in claim 2, wherein the gimbal plate is a metal plate that is partly bent, the first recording paper guide is formed at a first end, a second end, and a center of the end of the lid in a longitudinal direction of the end of the lid, and the second recording paper face guide is positioned in a space where the first recording paper guide is absent.

4. The printer as claimed in claim 1, wherein the first recording paper guide and the second recording paper guide alternate with each other along the end of the lid.

5. The printer as claimed in claim 1, wherein the fixed blade unit further includes a conveyance motor, a movable blade motor, a conveyance gear box, and a movable blade gear box, a platen roller is provided on the movable blade unit, the platen roller is rotated by the conveyance motor via gears in the conveyance gear box, and the movable blade is driven by the movable blade motor via gears in the movable blade gear box.

* * * * *